US008009843B2

(12) United States Patent
Akino

(10) Patent No.: US 8,009,843 B2
(45) Date of Patent: Aug. 30, 2011

(54) MICROPHONE CIRCUIT

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 1140 days.

(21) Appl. No.: 11/749,401

(22) Filed: May 16, 2007

(65) Prior Publication Data

US 2007/0269058 A1 Nov. 22, 2007

(30) Foreign Application Priority Data

May 22, 2006 (JP) ..... 2006-141065

(51) Int. Cl.
*H04R 3/00* (2006.01)

(52) U.S. Cl. ..... 381/113; 381/122; 381/123; 381/375

(58) Field of Classification Search ..... 381/122, 381/91, 111, 113, 123, 375
See application file for complete search history.

(56) References Cited

U.S. PATENT DOCUMENTS 4,567,608 A * 1/1986 Watson et al. ..... 381/122
2002/0186855 A1* 12/2002 Akino et al. ..... 381/111
2005/0232442 A1* 10/2005 Seknicka ..... 381/92

FOREIGN PATENT DOCUMENTS

JP 2003-116193 4/2003

* cited by examiner

*Primary Examiner* — Devona E Faulk
*Assistant Examiner* — Disler Paul
(74) *Attorney, Agent, or Firm* — Oblon, Spivak, McClelland, Maier & Neustadt, L.L.P.

(57) ABSTRACT

A microphone circuit includes an amplifier for amplifying an electric signal output from an electroacoustic transducing module, an external power supply circuit capable of supplying power for driving at least the amplifier from the outside, a light source that is turned on when an external power is supplied through the external power supply circuit, and a photo relay having contacts that are turned on and off in response to blinking of the light source. The contacts of the photo relay are connected so as to output an output signal of the amplifier as a microphone output when the light source is turned on and output an output signal of the electroacoustic transducing module as the microphone output when the light source is turned off.

8 Claims, 3 Drawing Sheets

MICROPHONE CIRCUIT

BACKGROUND OF THE INVENTION

1. Field of the Invention

The present invention relates to a microphone circuit that includes an external power supply circuit, and obtains a microphone output even in a case where an external power is supplied or in a case where the external power is not supplied, by automatically switching a circuit corresponding to the respective cases.

2. Related Background of the Invention

Microphones can be grouped into a dynamic microphone, a ribbon type microphone, a condenser microphone and the like according to the transducing form of a microphone unit as an electroacoustic transducing module. The dynamic microphone and the ribbon type microphone have the advantage of being capable of carrying out electroacoustic conversion without a power supply, but they have the drawback that the output level is low. Accordingly, the dynamic microphone or the ribbon type microphone has a problem in that if an output cable is extended, noise penetrates into an output cable, which is a transmission line of a sound signal, due to the low output level, thereby causing a significant degradation of S/N ratio of the output signal.

In order to solve such problem, an amplifier is incorporated in the microphone side to amplify a signal at the microphone side and thus increase the signal level for transmission. In order to operate the above-described amplifier at the microphone side, a power supply is required, and thus as a means for supplying power to the microphone side, an amplifier module that operates with a phantom power supply is commercialized, paying attention to the phantom power supply that is often used in a condenser microphone. When the microphone output needs to be amplified at the microphone side, the above-described amplifier module is connected between the microphone and the microphone cable and the phantom power supply is connected, thereby supplying a phantom power from the outside. By doing this way, the above-described amplifier module operates to amplify the microphone output and thus increase the output level, so that even if noise penetrates when transmitting the microphone output via the microphone cable, the degradation of S/N ratio can be reduced.

The above-described phantom power is supplied to the microphone via the output cable of the microphone. The microphone cable in this case is typically constructed as to be removably mounted to the microphone by a 3-pin microphone connector defined by EIAJ RC-5236 "a latch-lock round connector for an audio system." In the above-described 3-pin microphone connector, typically, a first pin is used for grounding, a second pin used as the hot side of a signal, and a third pin used as the cold side of the signal. A ground line of the microphone cable, more specifically, a shielded line is connected to the first pin. A signal line at the hot side of the microphone cable is connected to the second pin, and a signal line at the cold side is connected to the third pin.

If the amplifier module is mounted between a dynamic microphone and the microphone cable, the dynamic microphone is physically coupled to the amplifier module, thus causing a problem that the microphone portion is enlarged. The above-described problem can be dissolved by interposing a cable between the dynamic microphone and the amplifier module. However, interposing of the above-described cable increases the number of connection points by a connector, thus increasing the factors to cause contact failure and the factors to cause noise penetration due to the presence of the connecting portion by to the connector.

A product made by incorporating the amplifier, which operates with a phantom power supply, into a ribbon type microphone is also commercialized. This ribbon type microphone with the built-in amplifier is however a product on condition that there is a phantom power supply, and thus without the phantom power supply it is impossible to obtain the output and thus this ribbon type microphone can not be used.

In addition, as a prior art related to the present invention, there is proposed a microphone power supply device including: a gain detector for detecting a gain of a microphone amplifier to which a microphone is connected; a gain determination unit that determines an apparatus, which is connected to the microphone amplifier, based on the gain which the gain detector detects; a power supply controller for controlling power supply to the microphone; and a power supply unit for supplying power to the microphone, wherein the power supply controller is controlled based on the gain of the microphone amplifier (e.g., see Patent Document 1: Japanese Patent Application Laid-open No. 2003-116193).

However, the invention described in Patent Document 1 is the one for automatically controlling the power supply controller based on the gain of the apparatus connected to the microphone amplifier, and as long as the automatically controlling of the power supply controller is concerned, the invention described in Patent Document 1 is related to the present invention, however, it differs from the present invention in the problem to be solved and in the means for solving the problem.

SUMMARY OF THE INVENTION

[Problem to be Solved by the Invention]

The present invention is intended to provide a microphone circuit that includes an amplifier and a circuit capable of supplying an external power, and obtains a microphone output even in a case where an external power is supplied or in a case where the external power is not supplied, by automatically switching a circuit corresponding to the respective cases.

[Means for Solving the Problem]

A main feature of the present invention is a microphone circuit including: an electroacoustic transducing module for receiving a sound wave to convert it into an electric signal; an amplifier for amplifying the electric signal output from the electroacoustic transducing module; an external power supply circuit capable of supplying power for driving at least the amplifier from the outside; a light source that is turned on when the external power is supplied through the external power supply circuit; and a photo relay having contacts that are turned on and off in response to blinking of the light source, wherein the contacts of the photo relay are connected so as to output an output signal of the amplifier as a microphone output when the light source is turned on and output an output signal of the electroacoustic transducing module as a microphone output when the light source is turned off.

[Advantages of the Invention]

The contacts of the photo relay are turned on and off depending on when the external power is supplied and when the external power is not supplied, respectively, and when the external power is supplied and the light source of the photo relay is turned on, the output signal of the amplifier is the microphone output and is output with a sufficiently high output level. When the external power is not supplied and the light source of the photo relay is turned off, the contacts of the photo relay cause the output signal of the electroacoustic transducing module to be output as the microphone output, and therefore, although the output level is low, it is possible to prevent a situation where the microphone output can not be taken.

DESCRIPTION OF THE PREFERRED EMBODIMENTS

Embodiments of a microphone circuit concerning the present invention will be described below with reference to the accompanying drawings.

Embodiment 1

Figure 1:
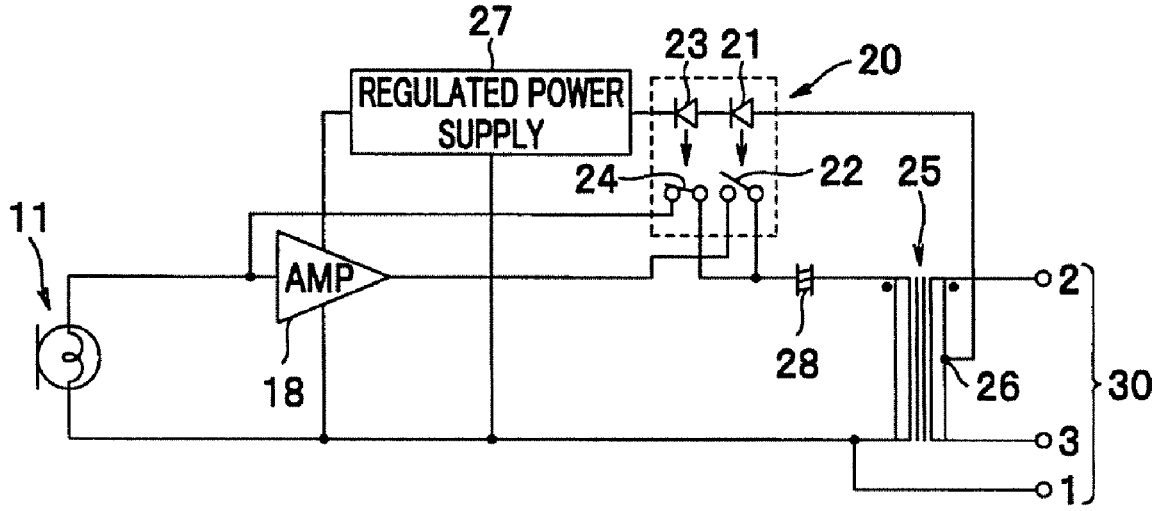
FIG. 1 is a circuit diagram showing a first embodiment of a microphone circuit concerning the present invention.

FIG. 1 shows an embodiment using a dynamic microphone unit as an electroacoustic transducing module that receives and converts a sound wave into an electric signal. In FIG. 1, one output terminal of a dynamic microphone unit 11 is connected to an input terminal of an amplifier 18 and the other output terminal of the dynamic microphone unit 11 is grounded. Power for operating the amplifier 18 is typically supplied from a phantom power supply, which is used as an external power supply of a condenser microphone. The phantom power is supplied to the microphone from the outside via a 3-line type microphone cable consisting of a ground line, a hot side signal line, and a cold side signal line.

The above-described ground line is a shielded line, and the shielded line wraps around the hot side signal line and the cold side signal line via an insulating coating. Each line of the above-described microphone cable is coupled to the microphone via a connector 30. The connector 30 is a 3-pin type connector, and the ground line of the microphone cord is connected to a first pin, which is grounded at the microphone side. The signal line at the hot side of the microphone cord is connected to a second pin of the connector 30, and the signal line at the cold side of the microphone cord is connected to a third pin of the connector 30. The second and third pins are connected to one end and the other end of the secondary winding of an output transformer 25 at the microphone side, respectively. The secondary winding of the output transformer 25 has a center tap 26, and the center tap 26 is connected to a power terminal of the amplifier 18 via a light source of a photo relay 20 and a regulated power supply 27. As is known, the phantom power is supplied in balance from the second and third pins of the connector 30 to join at the center tap 26 of the output transformer 25 and is supplied to the photo relay 20 and the amplifier 18.

The photo relay 20 includes: a light source that is turned on when the external power is supplied through the above-described phantom power supply circuit, which is an external power supply circuit; and contacts that are turned on and off in response to the blinking of the light source. For the photo relay 20, it is preferable to use a Photo-MOS relay including LEDs as the light source and MOS-FETs as the contacts that are turned on and off in response to the blinking of the LEDs. Moreover, for the MOS-FETs as the contacts, the ones including an a-contact that is turned on by turning on of the LEDs and is turned off by turning off of the LEDs, and a b-contact that is turned off by turning on of the LEDs and is turned on by turning off of the LEDs are used. The Photo-MOS relay with such configuration includes a Photo-MOS relay "TCLP4026G" made by Toshiba Corp., for example, and this is used in the embodiment. In FIG. 1, reference numeral 22 represents the a-contact included in the photo relay 20 and reference numeral 24 represents the b-contact included in the photo relay 20. The photo relay 20 includes two serially-connected LEDs 21, 23 as the light source. The phantom power supply is connected to the power terminal of the amplifier 18 via these two LEDs 21, 23 and the regulated power supply 27 so as to supply power to the amplifier 18.

The output terminal of the amplifier 18 is connected to one end side of the primary winding of the output transformer 25 via an a-contact 22 of the photo relay 20 and a capacitor 28. The b-contact 24 of the photo relay 20 is connected so as to bypass the amplifier 18 and output an output signal of the dynamic microphone unit 11, which is the electroacoustic transducing module, as the microphone output. Specifically, one output terminal of the dynamic microphone unit 11 is connected to the input terminal of the amplifier 18 and is connected to one end side of the primary winding of the output transformer 25 via the serially-connected b-contact 24 and the capacitor 28, as described above. The other end side of the primary winding of the output transformer 25 is an earth terminal, and this earth terminal is grounded at the microphone side together with the other output terminal of the dynamic microphone unit 11, the first pin of the connector 10, an earth terminal of the amplifier 18, and an earth terminal of the regulated power supply 27.

As apparent from the embodiment shown in FIG. 1, the turning on of LEDs 21, 23 of the photo relay 20 is controlled by the current flowing in from the center tap 26 of the output transformer 25. That is, when the phantom power is supplied, power is supplied from the center tap 26 to the amplifier 18 via LEDs 21, 23 to turn on LEDs 21, 23 and operate the amplifier 18. By turning on of LEDs 21, 23, the a-contact 22 of the photo relay 20 is turned on and the b-contact 24 is turned off. Turning on of the a-contact 22 allows the output signal of the amplifier 18 to be output as the microphone output, so that the output signal of the microphone is output with a sufficiently high level in combination with the operation of the amplifier 18. Incidentally, the microphone output is input from the second and third pins of the connector 30 to an external circuit via the hot side and cold side signal lines of the microphone cable.

When there is no phantom power supply or when phantom power is not supplied, power is not supplied to LEDs 21, 23 of the photo relay 20 and to the amplifier 18, so that LEDs 21, 23 are turned off and the amplifier 18 stops to operate. By turning off of LEDs 21, 23, the a-contact 22 of the photo relay 20 is turned off and the b-contact 24 is turned on. By turning on of the b-contact 24, the output signal of the dynamic microphone unit bypasses the amplifier 18 and is through the b-contact 24 and the capacitor 28, and is output from both terminals of the secondary winding of the output transformer 25 as the microphone output. In other words, it is possible to obtain an output as an ordinary microphone that does not incorporate the amplifier.

Assuming that there is no photo relay 20, then when external power is not supplied, the operation of the amplifier 18 stops and thereby the transmission of the output signal of the microphone unit 11 is cut off at the amplifier 18 and thus the microphone output can not be obtained. According to the embodiment shown in FIG. 1, however, even if external power is not supplied and the operation of the amplifier 18 stops, due to the presence of the photo relay 20 the output signal of the microphone unit 11 is output as the microphone output signal, and thus a situation where the microphone output is not obtained can be prevented. In addition, since the photo relay 20 automatically switches the microphone circuit depending on when the external power is supplied and when the external power is not supplied, it is possible to prevent a wrong operation as in manual switching operation.

Embodiment 2

Figure 2:
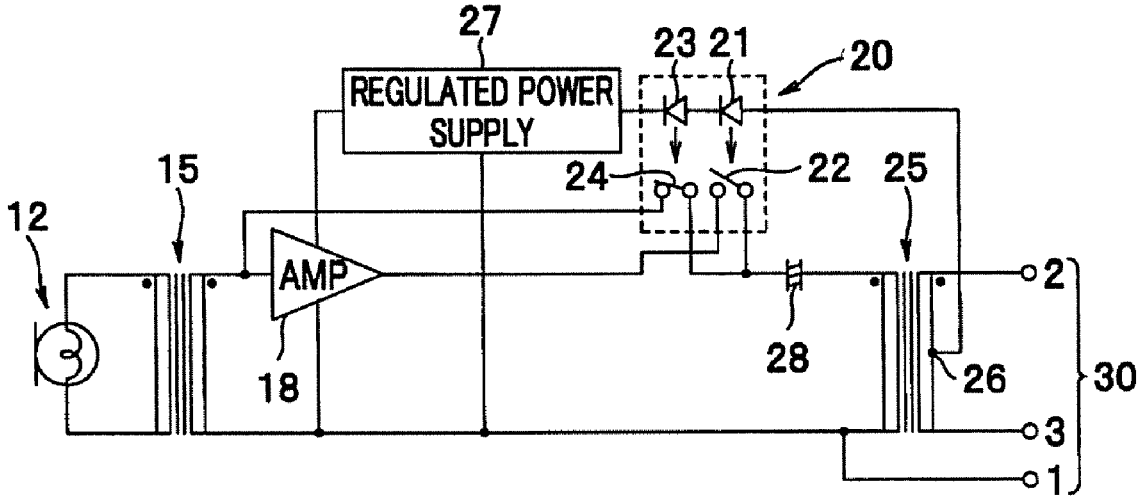
FIG. 2 is a circuit diagram showing a second embodiment of the microphone circuit concerning the present invention.

Next, an embodiment shown in FIG. 2 is described. This embodiment is a one using a ribbon microphone unit 12 as the electroacoustic transducing module. Since the output signal level of the ribbon microphone unit 12 is low, the output signal is input to the amplifier 18 after the output signal level is boosted using an input transformer 15 of a winding ratio of about 1:70. The description of other configuration, i.e., the connector 30 for the signal output and introducing of the phantom power, the output transformer 25, the photo relay 20, the amplifier 18, and the like, is omitted because these are the same as those of the embodiment shown in FIG. 1.

Also in the embodiment shown in FIG. 2, when the phantom power is supplied, LEDs 21, 23 of the photo relay 20 are turned on and the amplifier 18 operates, and the a-contact 22 is turned on to thereby output the output signal of the amplifier 18 as the microphone output. When the phantom power is not supplied, LEDs 21, 23 of the photo relay 20 are turned off and the a-contact 22 of the photo relay 20 is turned off and the b-contact 24 is turned on, and thereby after the output signal of the ribbon type microphone unit is boosted by the input transformer 15, it is outputted as the microphone output from both terminals of the secondary winding of the output transformer 25 via the b-contact 24. In other words, even if the external power is not supplied, it is possible to output as the output signal of an ordinary ribbon type microphone unit that does not contain the amplifier.

Embodiment 3

Figure 3:
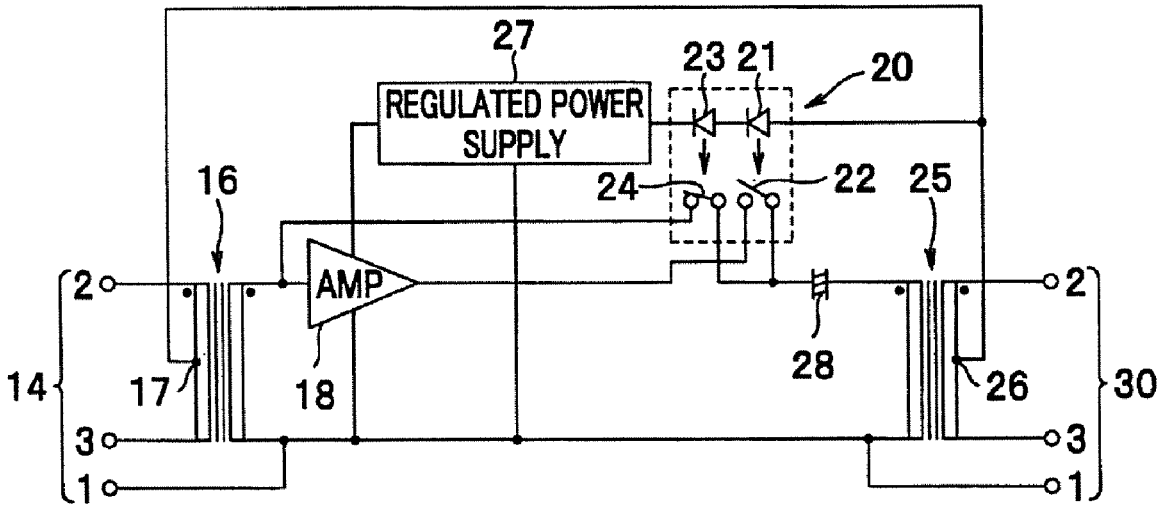
FIG. 3 is a circuit diagram showing a third embodiment of the microphone circuit concerning the present invention.

Next, an embodiment shown in FIG. 3 is described. This embodiment is configured assuming that as the electroacoustic transducing module a condenser microphone unit is used, and thus the circuit is designed such that a dynamic type microphone unit including a ribbon type can be selectively used. The connector 30 for the signal output and introducing of the phantom power, the output transformer 25, the photo relay 20, the amplifier 18, and the like are configured similarly as the embodiments shown in FIG. 1 and FIG. 2. In FIG. 3, an input transformer 16 is disposed at the preceding stage of the amplifier 18, and one end of the secondary coil of the input transformer 16 is connected to the input terminal of the amplifier 18. The other end of the secondary coil of the input transformer 16 is grounded. The primary coil of the input transformer 16 has a center tap 17, and this center tap 17 is connected to the center tap 26 of the secondary coil of the output transformer 25. One end of the primary coil of the input transformer 16 is connected to a second pin of a connector 14 at the input side, the other end of the primary coil is connected to a third pin of the connector 14, and a first pin of the connector 14 is grounded.

A microphone unit is connected to the connector 14. When the microphone unit is a condenser microphone unit, as is known, phantom power flows in from the center tap 17 of the primary winding of the input transformer 16, and is divided into both sides of the primary winding to be supplied to the electrodes of the condenser microphone unit via the second and third pins of the connector 14. An output signal of the condenser microphone unit is input to the amplifier 18 via the connector 14 and the input transformer 16. By supplying of the phantom power, LEDs 21, 23 of the photo relay 20 are turned on and the contact 22 is turned on and the contact 24 is turned off, and the output signal of the amplifier 18 is output to the outside via the contact 22, the capacitor 28, the output transformer 25, and the connector 30.

Also when a dynamic type microphone unit or a ribbon type microphone unit is used as the electroacoustic transducing module, the output signal is input to the amplifier 18 from the second and third pins of the connector 14 via the input transformer 16. When phantom power is supplied, the output of the amplifier 18 is output to the outside via the contact 22, the capacitor 28, the output transformer 25, and the connector 30, similarly as the embodiments shown in FIG. 1 and FIG. 2. Since the amplifier 18 will not operate when the phantom power is not supplied, the output of the microphone unit is output to the outside via the input transformer 16, the contact 24, the capacitor 28, the output transformer 25, and the connector 30. In other words, as in an ordinary microphone that does not include the amplifier 18, the output of the microphone unit is output to the outside without being amplified at the amplifier 18.

Among the microphones including a condenser microphone unit as the electroacoustic transducing module, there is the one that does not require a phantom power supply by including an internal power supply or the one consisting mainly of a phantom power supply and using a built-in power supply as backup. In such condenser microphone, when phantom power is not supplied, the output of the microphone unit itself is output to the outside without being amplified at the amplifier 18, as when a dynamic type microphone unit or a ribbon type microphone unit is used and the phantom power is not supplied.

What is claimed is:

1. A microphone circuit, comprising:

an electroacoustic transducing module for receiving a sound wave to convert it into an electric signal;

an amplifier for amplifying the electric signal output from the electroacoustic transducing module;

an external power supply circuit capable of supplying power for driving at least the amplifier from the outside;

a light source that is turned on when the external power is supplied through the external power supply circuit; and a photo relay having contacts that are turned on and off in response to blinking of the light source, wherein the contacts of the photo relay are connected so as to output an output signal of the amplifier as a microphone output when the light source is turned on and output an output signal of the electroacoustic transducing module as a microphone output when the light source is turned off.

2. The microphone circuit according to claim 1, wherein the power is a phantom power, and the external power supply circuit includes: a 3-line type microphone cable consisting of a ground line, a hot side signal line, and a cold side signal line; and a 3-pin type connector for coupling this microphone cable.

3. The microphone circuit according to claim 1, wherein the photo relay includes a contact that is turned on by turning on of the light source, and a contact that is turned on by turning off of the light source; and wherein the photo relay is connected so as to output an output signal of the amplifier as a microphone output via the contact that is turned on by turning on of the light sources, and to bypass the amplifier through the contact that is turned on by turning off of the light source and thus output an output signal of the electroacoustic transducing module as the microphone output.

4. The microphone circuit according to claim 1, wherein the photo relay includes a Photo-MOS relay having LEDs as the light source and MOS-FETs as the contacts that are turned on and off in response to blinking of the LEDs.

5. The microphone circuit according to claim 2, wherein the photo relay includes a Photo-MOS relay having LEDs as the light source and MOS-FETs that are turned on and off in response to blinking of the LEDs; and wherein the blinking of the LEDs is controlled by a current that flows in from a center tap of an output transformer used for a phantom power supply.

6. The microphone circuit according to claim 1, wherein the electroacoustic transducing module is a dynamic microphone unit.

7. The microphone circuit according to claim 1, wherein the electroacoustic transducing module is a ribbon type microphone unit.

8. The microphone circuit according to claim 1, wherein the electroacoustic transducing module is capable of selectively connecting a dynamic microphone unit and a condenser microphone unit.

* * * * *